US010028891B2

(12) United States Patent
Luo

(10) Patent No.: US 10,028,891 B2
(45) Date of Patent: Jul. 24, 2018

(54) ANTI-FLATULENCE MILK BOTTLE

(71) Applicant: Dongguan Bangfei Baby Products Co., Ltd., Dongguan, Guangdong (CN)

(72) Inventor: Zhiyong Luo, Guangdong (CN)

(73) Assignee: Dongguan Bangfei Baby Products Co., Ltd., Dongguan (CN)

( * ) Notice: Subject to any disclaimer, the term of this patent is extended or adjusted under 35 U.S.C. 154(b) by 0 days.

(21) Appl. No.: 15/493,084

(22) Filed: Apr. 20, 2017

(65) Prior Publication Data

US 2018/0021223 A1 Jan. 25, 2018

(30) Foreign Application Priority Data

Jul. 21, 2016 (CN) ..... 2016 2 0774362 U
Oct. 20, 2016 (CN) ..... 2016 2 1140629 U

(51) Int. Cl.

| | |
|---|---|
| ***A61J 9/04*** | (2006.01) |
| ***A61J 11/02*** | (2006.01) |
| ***A61J 11/00*** | (2006.01) |
| ***A61J 11/04*** | (2006.01) |
| ***B65D 23/10*** | (2006.01) |

(52) U.S. Cl.

CPC ..... *A61J 11/02* (2013.01); *A61J 11/008* (2013.01); *A61J 11/045* (2013.01); *B65D 23/102* (2013.01)

(58) Field of Classification Search

CPC ..... A61J 9/04
USPC ..... 215/11.5, 11.6, DIG. 7
See application file for complete search history.

(56) References Cited

U.S. PATENT DOCUMENTS

| | | | | |
|---|---|---|---|---|
| 3,077,279 | A * | 2/1963 | Mitchell | A61J 7/0046 215/11.1 |
| 3,704,803 | A * | 12/1972 | Ponder | A61J 9/006 215/11.2 |
| 6,112,919 | A * | 9/2000 | Ho | A61J 11/002 215/11.1 |
| 7,044,316 | B1 * | 5/2006 | Hsu | A61J 9/006 215/11.1 |
| 7,252,676 | B1 * | 8/2007 | Williams | A61J 7/0046 215/11.1 |
| 8,684,201 | B2 * | 4/2014 | Berkovitch | A61J 9/04 215/11.4 |
| 2003/0226816 | A1 * | 12/2003 | Kipperman | A61J 9/00 215/11.1 |
| 2004/0089626 | A1 * | 5/2004 | Pyun | A61J 9/006 215/11.5 |
| 2005/0236353 | A1 * | 10/2005 | Hsu | A61J 9/006 215/11.5 |

(Continued)

*Primary Examiner* — Sue A Weaver

(57) ABSTRACT

The disclosure discloses an anti-flatulence milk bottle, which comprises a bottle body and a nipple, wherein an edge of the nipple is arranged at a bottleneck of the bottle body through a threaded cover, the threaded cover is in threaded connection with a periphery of the bottleneck, a first air returning cover and a second air returning cover are arranged between the nipple and the bottleneck, a first gap is formed between the first air returning cover and the second air returning cover, a second gap is formed between the threaded cover and an outer surface of the bottleneck, the first gap is communicated with the second gap, the first air returning cover is provided with a first opening communicated with an interior of the bottle body, and the first gap, the second gap and the first opening form a confluence passage.

8 Claims, 7 Drawing Sheets

(56) References Cited

U.S. PATENT DOCUMENTS

2008/0217282 A1* 9/2008 Brown ..... A61J 9/006
215/11.5

* cited by examiner

ANTI-FLATULENCE MILK BOTTLE

CROSS-REFERENCE TO RELATED APPLICATIONS

This present application claims the benefit of Chinese Utility Model Application No. 201620774362.0 filed on Jul. 21, 2016 and Chinese Utility Model Application No. 201621140629.7 filed on Oct. 20, 2016, the contents of which are hereby incorporated by reference.

TECHNICAL FIELD

The disclosure relates to the field of articles for daily use, and more particularly to an anti-flatulence milk bottle.

BACKGROUND

When an infant is fed with a milk bottle, milk left in the milk bottle is gradually reduced along with suction of the milk in the milk bottle by the infant, and certain negative pressure is inevitably generated in the milk bottle, so that it is more and more difficult for the infant to suck the milk from the milk bottle, and the infant may only open the mouth for breathing. Because of incomplete development of the stomach of the infant, when the infant is fed with the milk bottle, the infant is very likely to breathe excessive air by suction to cause a flatulence phenomenon of the infant, and particularly when the infant sucks rapidly or a bottle body is inclined and the infant is fed at an incorrect posture, more air may be sucked into the stomach by the infant to worsen flatulence of the infant. Therefore, vacuum negative pressure generated by suction in the milk bottle may force the infant to increase suction force, which easily causes hiccup, milk regurgitation and even crying for stomach ache of the infant by excessive flatulence. Various discomforts caused by suction of the milk bottle may finally make the infant reject suction of the milk bottle, thereby losing an interest in drinking milk and further causing influence on development.

In order to solve the problem, a small-hole air valve capable of implementing one-way ventilation only is formed in a lateral surface of a nipple of an existing milk bottle on the market, and air outside the milk bottle may enter an interior of the milk bottle from the small-hole air valve to reduce vacuum negative pressure in the milk bottle. However, the small-hole air valve is very small, and when the negative pressure in the milk bottle reaches a certain pressure value, the small-hole air valve may be opened and return air into the milk bottle very slowly, so that there still exists a risk of flatulence. Moreover, the small-hole air valve is difficult to be assembled for mounting on the nipple due to its a complex structure, and is difficult to be cleaned due to its small structure, and it is easy to block an air returning passage and store scales.

SUMMARY

For the problem of a conventional art, the disclosure provides an anti-flatulence milk bottle which is simple in structure, easy to assemble and convenient to clean.

To this end, the technical solutions of the disclosures are implemented as follows.

An anti-flatulence milk bottle may comprise a bottle body and a nipple, an edge of the nipple may be arranged at a bottleneck of the bottle body through a threaded cover, the threaded cover may be in threaded connection with a periphery of the bottleneck, a first air returning cover and a second air returning cover may be arranged between the nipple and the bottleneck, a first gap may be formed between the first air returning cover and the second air returning cover, a second gap may be formed between the threaded cover and an outer surface of the bottleneck, the first gap may be communicated with the second gap, the first air returning cover may be provided with a first opening communicated with an interior of the bottle body, and the first gap, the second gap and the first opening may form a confluence passage configured for external air to enter the bottle body.

Furthermore, at least one air returning hole may be formed in the nipple, an air returning pipe may be connected to a bottom of the air returning hole, and the air returning pipe may be provided with a second opening communicated with the interior of the bottle body to form a second confluence passage configured for the external air to enter the bottle body.

Furthermore, two air returning holes may be formed in the nipple, each air returning hole may be connected with an air returning pipe, the air returning pipes may be symmetrically arranged in the nipple, and second openings may be formed in bottoms of the air returning pipes.

Furthermore, an edge of the first air returning cover may be lapped with the bottleneck, a first bump may be arranged in middle of the first air returning cover in a downward protruding manner, a recess may be formed at a corresponding position on a back surface of the first bump, and the first opening may be formed in a pointed end of the first bump.

Furthermore, an air collecting pipe may be arranged at a bottom of the first bump in a sleeving manner, the first opening may be communicated with the air collecting pipe, a fixed cap may be arranged below the air collecting pipe in the sleeving manner, a cap peak of the fixed cap may be closely attached to a bottom surface of the bottle body, an open groove may be formed in the fixed cap, and the external air entering from the first confluence passage may be introduced into the bottle body through the open groove after passing through the air collecting pipe.

Furthermore, the second air returning cover may be positioned above the first air returning cover, and may be partially accommodated in the first air returning cover, a second bump may be arranged in middle of the second air returning cover in the downward protruding manner, and the second bump may enter the recess.

Furthermore, a groove may be formed in a surface, contacting with the first air returning cover, of the second air returning cover, and the first gap may be formed between the groove and a surface of the first air returning cover.

Furthermore, at least one through hole may be formed in the first air returning cover, the second air returning cover may be correspondingly provided with at least one convex column, the convex column may correspondingly enter the through hole, the convex column may be provided with a through groove in a penetration manner, and the through groove may communicate the nipple with the interior of the bottle body.

Furthermore, an outer surface of the bottle body may be inwards sunken into an arc, and an antiskid bump may be arranged on a surface of the arc for a hand to hold.

Furthermore, a bottle cap may be arranged on a periphery of the nipple, and scales may be arranged on the bottle cap.

The disclosure has the following beneficial effects:

the first gap is formed between the first air returning cover and the second air returning cover, the second gap is formed between the threaded cover and the outer surface of the bottleneck, the first gap is communicated with the second gap, the first air returning cover is provided with the first opening communicated with the interior of the bottle body, and the first gap, the second gap and the first opening form the first confluence passage configured for the external air to enter the bottle body, so that a negative pressure state in the milk bottle is eliminated, internal and external air pressure of the bottle body is effectively balanced, milk in the milk body may be smoothly sucked into the nipple and further into the mouth when the infant sucks the milk, and a good anti-flatulence effect may be achieved. Moreover, the milk bottle of the disclosure is simple in structure, and the air returning covers are easy to assemble and convenient to clean.

BRIEF DESCRIPTION OF THE DRAWINGS

In order to describe the technical solutions in embodiments of the disclosure more clearly, the drawings required by descriptions of the embodiments will be simply introduced below. Obviously, the drawings the drawings described below are only some embodiments of the disclosure, and those skilled in the art may also obtain other drawings according to these drawings without creative work.

Figure 1:
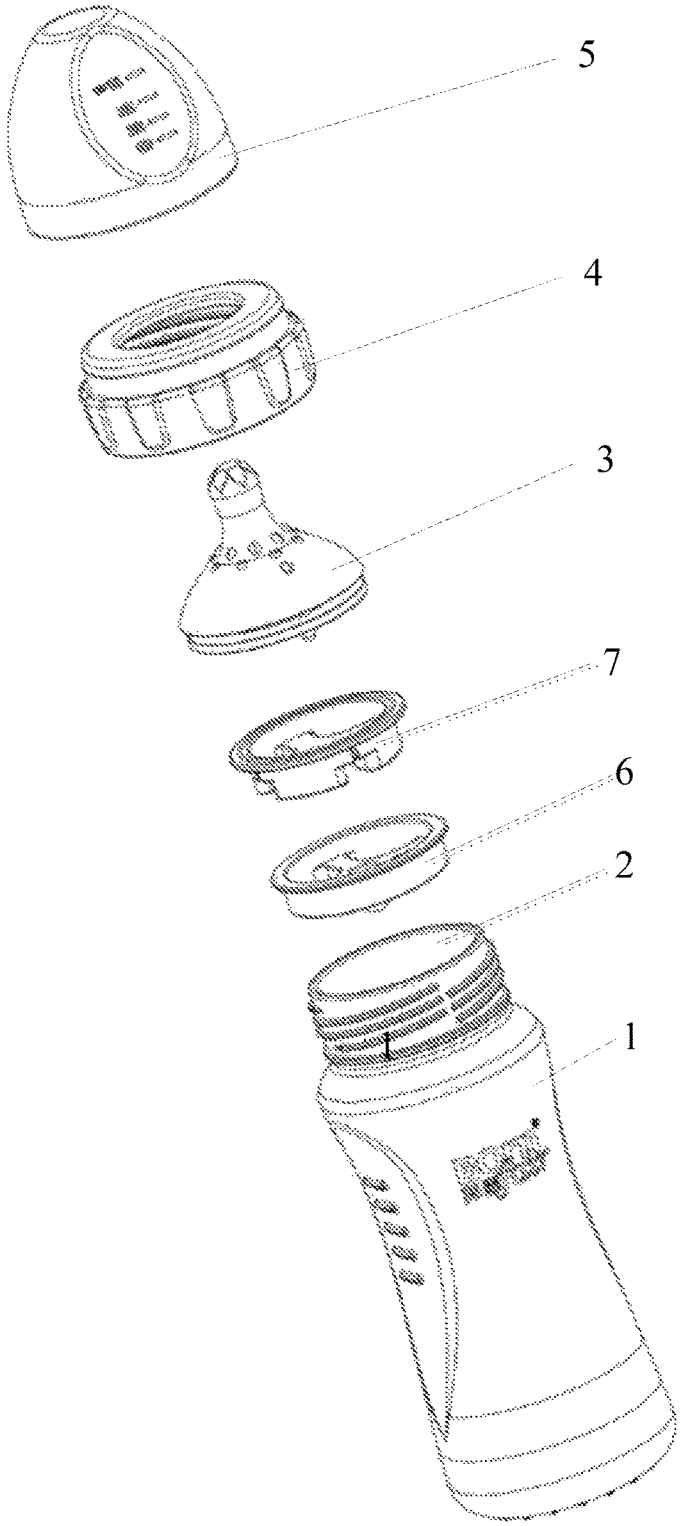
FIG. 1 is a structure diagram of a first embodiment of an anti-flatulence milk bottle according to the disclosure.

In the figures, 1—bottle body, 2—bottleneck, 3—nipple, 4—threaded cover, 5—bottle cap, 6—first air returning cover, 7—second air returning cover, 8—first gap, 9—second gap, 10—first bump, 11—recess, 12—first opening, 13—through hole, 14—second bump, 15—groove, 16—convex column, 17—through groove, 18—air collecting pipe, 19—fixed cap, 20—antiskid bump, 21—air returning hole, 22—air returning pipe and 23—second opening.

DETAILED DESCRIPTION

The technical solutions in the embodiments of the disclosure will be described clearly and completely below with reference to the drawings in the embodiments of the disclosure. Obviously, the described embodiments are not all embodiments but only a part of embodiments of the disclosure. All other embodiments obtained by those skilled in the art on the basis of the embodiments in the disclosure without creative work fall within the scope of protection of the disclosure.

It is important to note that all directional indications (such as upper, lower, left, right, front, rear . . . ) in the embodiments of the disclosure are only adopted to explain relative position relationships between each part, movement conditions and the like in a specific attitude (shown in the drawings), and if the specific attitude changes, the directional indications also correspondingly change.

As shown in FIG. 1 to FIG. 4, the disclosure provides an anti-flatulence milk bottle, which comprises a bottle body 1 and a nipple 3, an edge of the nipple 3 is arranged at a bottleneck 2 of the bottle body 1 through a threaded cover 4, the threaded cover 4 is in threaded connection with a periphery of the bottleneck 2, and a bottle cap 5 is arranged on a periphery of the nipple 3. An outer surface of the bottle body 1 is inwards sunken into an arc for a hand to conveniently hold. An antiskid bump 20 is arranged on the outer surface of the bottle body 1 to prevent the milk bottle from sliding down. Scales are arranged on both the bottle body 1 and the bottle cap 5, so that not only may a volume of milk therein be read through the scales of the bottle body 1, but also the bottle cap 5 may be independently used for containing a small amount of liquid.

Figure 4:
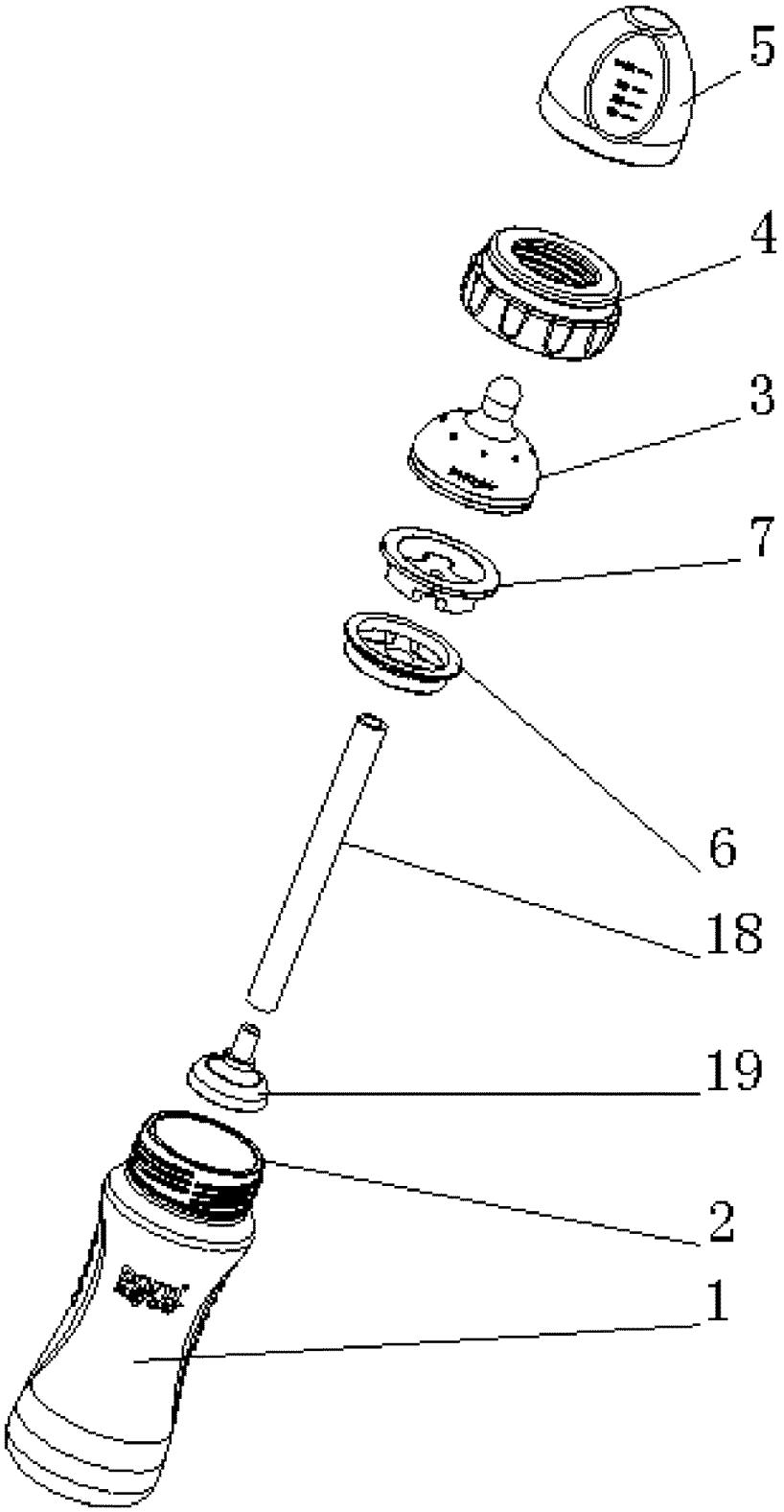
FIG. 4 is a structure diagram of a second embodiment of an anti-flatulence milk bottle according to the disclosure.

As shown in FIG. 1 and FIG. 4, a first air returning cover 6 and a second air returning cover 7 are arranged between the nipple 3 and the bottleneck 2, the first air returning cover 6 and the second air returning cover 7 are stacked, the first air returning cover 6 is arranged below the second air returning cover 7, an edge of the first air returning cover 7 is lapped with the bottleneck 2, a middle part enters the bottleneck 2, an edge of the second air returning cover 7 is lapped with the edge of the first air returning cover 6, a middle part is accommodated in the first air returning cover 6, and the nipple 3 is arranged above the second air returning cover 7, and is pressed by the threaded cover 4 to prevent separation.

Figure 2:
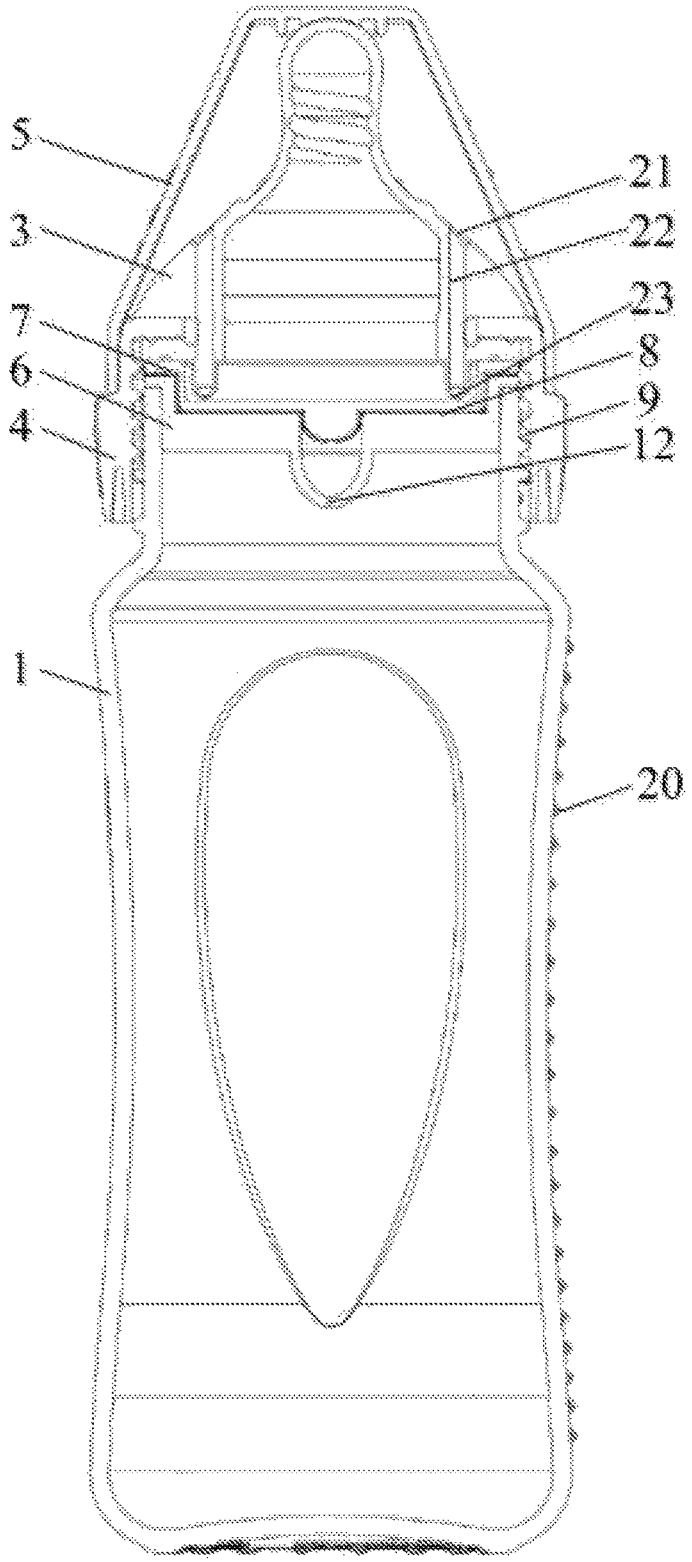
FIG. 2 is a sectional view of FIG. 1.
Figure 3:
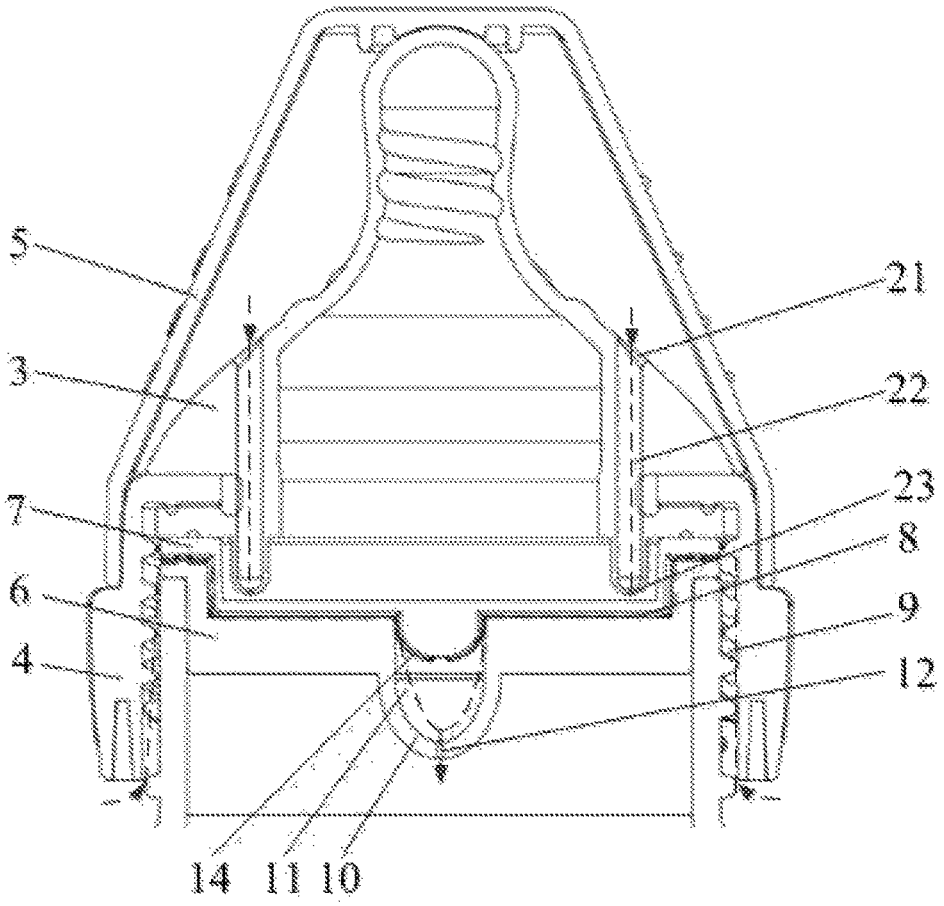
FIG. 3 is a structure diagram of a part at a nipple and bottleneck in FIG. 2.

As shown in FIG. 2 and FIG. 3, in a first embodiment, a first gap 8 is formed between the first air returning cover 6 and the second air returning cover 7, a second gap 9 is formed between the threaded cover 4 and an outer surface of the bottleneck 2, the first gap 8 is communicated with the second gap 9, the first air returning cover 6 is provided with a first opening 12 communicated with an interior of the bottle body 1, and the first gap 8, the second gap 9 and the first opening 12 form a confluence passage for external air to enter the bottle body 1, so that negative pressure in the milk bottle is eliminated, and internal and external air pressure is kept balanced to prevent flatulence.

At least one air returning hole 21 is formed in the nipple 3, an air returning pipe 22 is connected to a bottom of the air returning hole 21, the air returning pipe 22 is provided with a second opening 23 communicated with the interior of the bottle body 1 to form a second confluence passage, and the external air enters the air returning pipe 22 from the air returning hole 21, and enters the bottle body 1 through the second opening 23 and a through groove 17. Under a double air returning effect of the first confluence passage and the second confluence passage, the external air may be ensured to enter the bottle body 1, a negative pressure state in the milk bottle is eliminated, internal and external air pressure of the bottle body is effectively balanced, milk in the milk body 1 may be sucked into the nipple 3 and further into the mouth when the infant sucks the milk, and a good anti-flatulence effect may be achieved. In the embodiment, two air returning holes 21 are formed in the nipple 3, each air returning hole 21 is connected with an air returning pipe 22, and the air returning pipes 22 are symmetrically arranged in the nipple 3. The air returning pipes 22 are arranged below the air returning holes 21 of the nipple 3, and the air returning pipes 22 may be independently cleaned, so that sanitation and safety are ensured.

As shown in FIG. 7 to FIG. 10, a first bump 10 is arranged in middle of the first air returning cover 6 in a downward protruding manner, a recess 11 is formed at a corresponding position on a back surface of the first bump 10, and the first opening 12 is formed in a pointed end of a bottom of the first bump 10. The second air returning cover 7 is positioned above the first air returning cover 6, and is partially accommodated in the first air returning cover 6, a second bump 14 is arranged in middle of the second air returning cover 7 in the downward protruding manner, the second bump 14 enters the recess 11, and the second bump 14 and a bottom of the recess 11 are not completely attached, with a gap formed therebetween. A groove 15 is formed in a surface, contacting with the first air returning cover 6, of the second air returning cover 7, the groove 15 is crosswise formed in a bottom surface of the second air returning cover 7, and extends onto the second bump 14, and the first gap 8 is formed between the groove 15 and an upper surface of the first air returning cover 6.

As shown in FIG. 7 to FIG. 10, at least one through hole 13 is formed in the first air returning cover 6, the second air returning cover 7 is correspondingly provided with at least one convex column 16, and the convex column 16 correspondingly enters the through hole 13, so that the convex column 16 and the through hole 13 are matched to position the first air returning cover 6 and the second air returning cover 7, and convenience for assembling is achieved. In the embodiment, four through holes 13 are formed, and are uniformly distributed in the first air returning cover 6, the four through holes 13 are separated by a cross partition plate, and the first bump 10 is arranged in a center of the partition plate. The convex column 16 of the second air returning cover 7 corresponds to the through hole 13 of the first air returning cover 6 one to one, each convex column 16 is provided with a through groove 17 in a penetration manner, and the through groove 17 communicates the nipple 3 with the interior of the bottle body 1, so that the milk in the bottle body 1 may enter the nipple 3 through the through groove 17.

Figure 5:
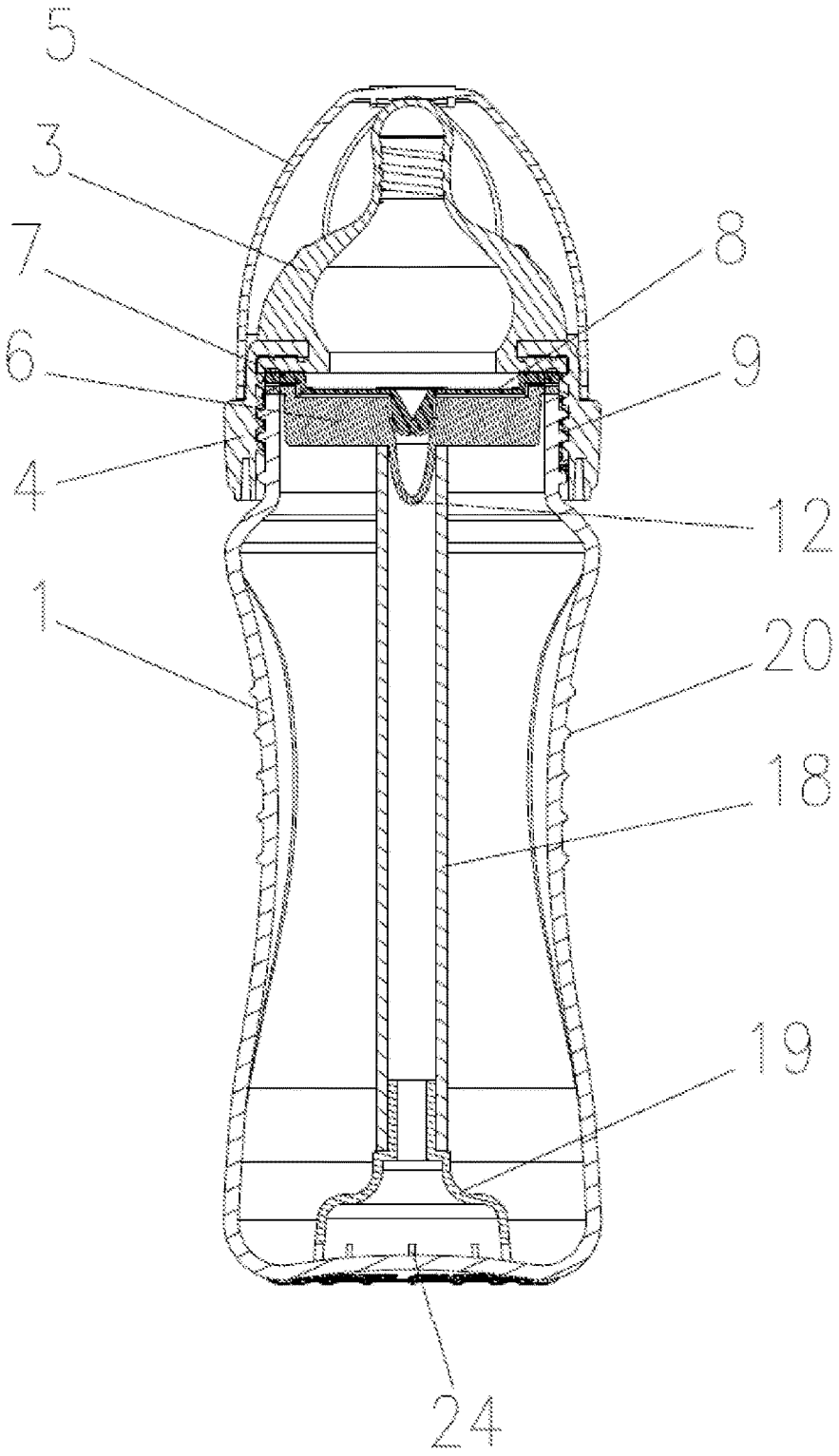
FIG. 5 is a sectional view of FIG. 4.
Figure 6:
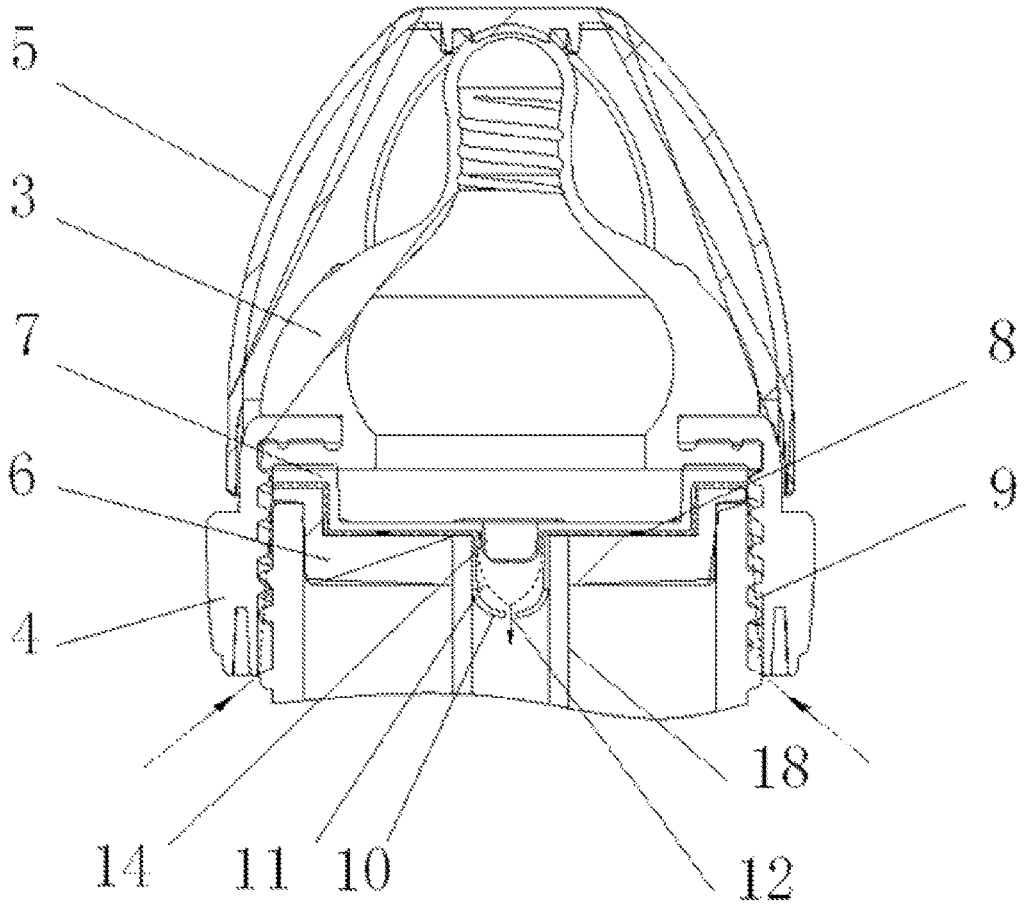
FIG. 6 is a structure diagram of a part at a nipple and bottleneck in FIG. 5.
Figure 7:
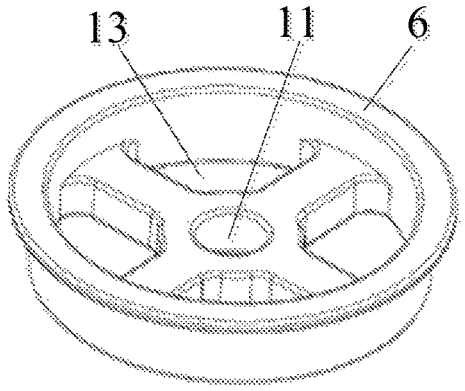
FIG. 7 is a structure diagram of a first air returning cover in an anti-flatulence milk bottle according to the disclosure.
Figure 8:
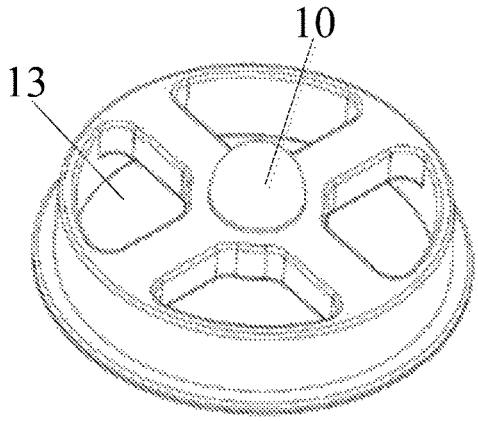
FIG. 8 is a structure diagram of a first air returning cover in FIG. 7 from another angle of view.
Figure 9:
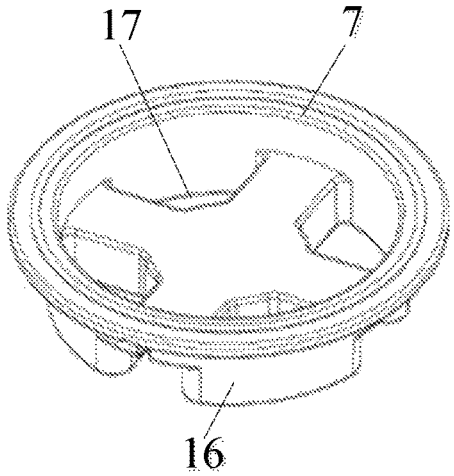
FIG. 9 is a structure diagram of a second air returning cover in an anti-flatulence milk bottle according to the disclosure.
Figure 10:
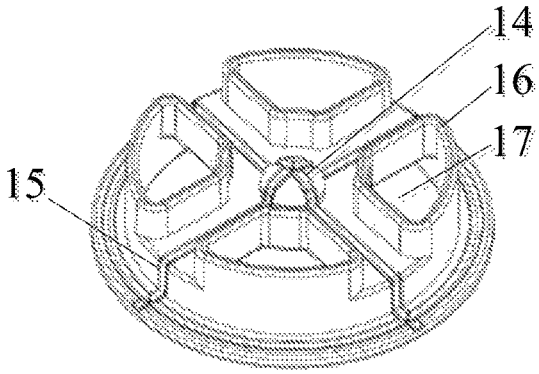
FIG. 10 is a structure diagram of a second air returning cover in FIG. 9 from another angle of view.

As shown in FIG. 4 to FIG. 6, structures of a second embodiment and first embodiment of the disclosure are substantially the same. The only difference with the first embodiment is that an air collecting pipe 18 is arranged at a bottom of the first bump 10 of the first air returning cover 6 in a sleeving manner, the first opening 12 is communicated with the air collecting pipe 18, a fixed cap 19 is arranged below the air collecting pipe 18 in the sleeving manner, a cap peak of the fixed cap 19 is closely attached to a bottom surface of the bottle body 1, an open groove 24 is formed in the fixed cap 19, the external air entering from the first confluence passage is introduced into the bottle body 1 through the open groove 24 after passing through the air collecting pipe 18, and at this moment, the first confluence passage is formed by the first gap 8, the second gap 9, the first opening 12, the air collecting pipe 18 and the open groove 24. The external air enters a bottle bottom and then the bottle body 1 from the air collecting pipe 18, and the air returns the bottom of the milk bottle from the air collecting pipe 18, so that excessive contact between oxygen and the milk is reduced, oxidization of the milk is reduced, the negative pressure in the milk bottle is also eliminated, and the internal and external air pressure is kept balanced to prevent flatulence.

According to the disclosure, under the air returning effect of the first confluence passage, the external air may be ensured to enter the bottle body 1, the negative pressure state in the milk bottle is eliminated, the internal and external air pressure of the bottle body is effectively balanced, the milk in the milk body 1 may be smoothly sucked into the nipple 3 and further into the mouth when the infant sucks the milk, and a good anti-flatulence effect may be achieved. The second confluence passage may also be additionally formed, so that a double air returning effect is achieved. Fittings of the milk bottle of the disclosure are simple and practical in structure, easy to assemble and convenient to clean. The convex column 16 and the through hole 13 are matched to position the first air returning cover 6 and the second air returning cover 7, so that simple structure and convenience for assembling are achieved, and the two may be disassembled for independent cleaning.

The above embodiments are adopted to only describe rather than limit the technical solutions of the disclosure. Although detailed descriptions about the disclosure have been made with reference to preferred embodiments, it should be understood that those skilled in the art may make modifications or equivalent replacements to the technical solutions of the disclosure without departing from the purpose and scope of the technical solutions, which shall fall within the scope of the claims of the disclosure.

What is claimed is:

1. An anti-flatulence milk bottle, comprising a bottle body and a nipple, an edge of the nipple being arranged at a bottleneck of the bottle body through a threaded cover and the threaded cover being in threaded connection with a periphery of the bottleneck, wherein a first air returning cover and a second air returning cover are arranged between the nipple and the bottleneck, a first gap is formed between the first air returning cover and the second air returning cover, a second gap is formed between the threaded cover and an outer surface of the bottleneck, the first gap is communicated with the second gap, the first air returning cover is provided with a first opening communicated with an interior of the bottle body, and the first gap, the second gap and the first opening form a confluence passage configured for external air to enter the bottle body, wherein an edge of the first air returning cover is lapped with the bottleneck, a first bump is arranged in middle of the first air returning cover in a downward protruding manner, a recess is formed at a corresponding position on a back surface of the first bump, and the first opening is formed in a pointed end of the first bump, and wherein the second air returning cover is positioned above the first air returning cover, and is partially accommodated in the first air returning cover, a second bump is arranged in middle of the second air returning cover in the downward protruding manner, and the second bump enters the recess.

2. The anti-flatulence milk bottle according to claim 1, wherein at least one air returning hole is formed in the nipple, an air returning pipe is connected to a bottom of the air returning hole, and the air returning pipe is provided with a second opening communicated with the interior of the bottle body to form a second confluence passage configured for the external air to enter the bottle body.

3. The anti-flatulence milk bottle according to claim 2, wherein two air returning holes are formed in the nipple, each air returning hole is connected with an air returning pipe, the air returning pipes are symmetrically arranged in the nipple, and second openings are formed in bottoms of the air returning pipes.

4. The anti-flatulence milk bottle according to claim 1, wherein an air collecting pipe is arranged at a bottom of the first bump in a sleeving manner, the first opening is communicated with the air collecting pipe, a fixed cap is arranged below the air collecting pipe in the sleeving manner, a cap peak of the fixed cap is closely attached to a bottom surface of the bottle body, an open groove is formed in the fixed cap, and the external air entering from the first confluence passage is introduced into the bottle body through the open groove after passing through the air collecting pipe.

5. The anti-flatulence milk bottle according to claim 1, wherein a groove is formed in a surface, contacting with the first air returning cover, of the second air returning cover, and the first gap is formed between the groove and a surface of the first air returning cover.

6. The anti-flatulence milk bottle according to claim 1, wherein at least one through hole is formed in the first air returning cover, the second air returning cover is correspondingly provided with at least one convex column, the convex column correspondingly enters the through hole, the convex column is provided with a through groove in a penetration manner, and the through groove communicates the nipple with the interior of the bottle body.

7. The anti-flatulence milk bottle according to claim 1, wherein an outer surface of the bottle body is inwards sunken into an arc, and an antiskid bump is arranged on a surface of the arc for a hand to hold.

8. The anti-flatulence milk bottle according to claim 1, wherein a bottle cap is arranged on a periphery of the nipple, and scales are arranged on the bottle cap.

* * * * *